US008260462B2

(12) United States Patent
Lin et al.

(10) Patent No.: US 8,260,462 B2
(45) **Date of Patent: *Sep. 4, 2012**

(54) TOUCH SENSITIVE ROBOT

(75) Inventors: Chen-Ter Lin, Taipei Hsien (TW); Yung-Hung Chu, Taipei Hsien (TW); Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 525 days.

This patent is subject to a terminal disclaimer.

(21) Appl. No.: 12/537,261

(22) Filed: Aug. 7, 2009

(65) Prior Publication Data

US 2010/0228395 A1 Sep. 9, 2010

(30) Foreign Application Priority Data

Mar. 3, 2009 (CN) ..... 2009 1 0300664

(51) Int. Cl.
*G05B 15/00* (2006.01)

(52) U.S. Cl. ..... 700/258; 700/245; 700/264

(58) Field of Classification Search ..... 701/245–264
See application file for complete search history.

(56) References Cited

U.S. PATENT DOCUMENTS 6,389,329 B1 * 5/2002 Colens ..... 700/262
6,459,955 B1 * 10/2002 Bartsch et al. ..... 700/245
6,483,054 B2 * 11/2002 Suzuki et al. ..... 200/61.44
6,748,297 B2 * 6/2004 Song et al. ..... 700/259
6,917,002 B2 * 7/2005 Burgess et al. ..... 200/61.25
7,102,089 B2 * 9/2006 Burgess et al. ..... 200/61.43
7,332,890 B2 * 2/2008 Cohen et al. ..... 320/109
7,342,190 B2 * 3/2008 Burgess et al. ..... 200/61.43
7,346,428 B1 * 3/2008 Huffman et al. ..... 700/245
7,429,843 B2 * 9/2008 Jones et al. ..... 318/568.12
7,474,941 B2 * 1/2009 Kim et al. ..... 700/258
7,577,499 B2 * 8/2009 Sun et al. ..... 700/255
2001/0017587 A1 * 8/2001 Suzuki et al. ..... 340/545.7
2005/0010331 A1 * 1/2005 Taylor et al. ..... 700/245
2007/0016328 A1 * 1/2007 Ziegler et al. ..... 700/245
2008/0125907 A1 * 5/2008 Lee et al. ..... 700/245
2008/0155768 A1 * 7/2008 Ziegler et al. ..... 15/4
2008/0281470 A1 * 11/2008 Gilbert et al. ..... 700/259
2008/0300720 A1 * 12/2008 Kim et al. ..... 700/245

* cited by examiner

*Primary Examiner* — Mary Cheung
*Assistant Examiner* — Truc M Do
(74) *Attorney, Agent, or Firm* — Altis Law Group, Inc.

(57) ABSTRACT

A touch sensitive robot includes a body having a control panel, a touch sensor, a driver, and a controller. The touch sensor includes a first conductive belt, a second conductive belt, a power source, and a current sensor. The first conductive belt is wrapped on the body. The second conductive belt is wrapped around but spaced away from the first conductive belt. The power source and the current sensor are connected in series between the first conductive belt and the second conductive belt to form a closed circuit when a point of the second conductive belt is touched to contact the first conductive belt. The current sensor is for measuring the flow of the electrical current of the close loop. The controller is for controlling the driver to turn the body based upon the measurement of the current sensor to orient the control panel to the touch point.

1 Claim, 5 Drawing Sheets

TOUCH SENSITIVE ROBOT

BACKGROUND

1. Technical Field

The present disclosure relates to robots and, particularly, to a touch sensitive robot.

2. Description of Related Art

Touch sensitivity of most touch sensitive robots are realized by pressure sensors. However, because of a great number of pressure sensors required to make the entire body touch sensitive, the cost is exorbitant.

Therefore, it is desirable to provide a touch sensitive robot, which can overcome the above-mentioned problem.

DETAILED DESCRIPTION

Figure 1:
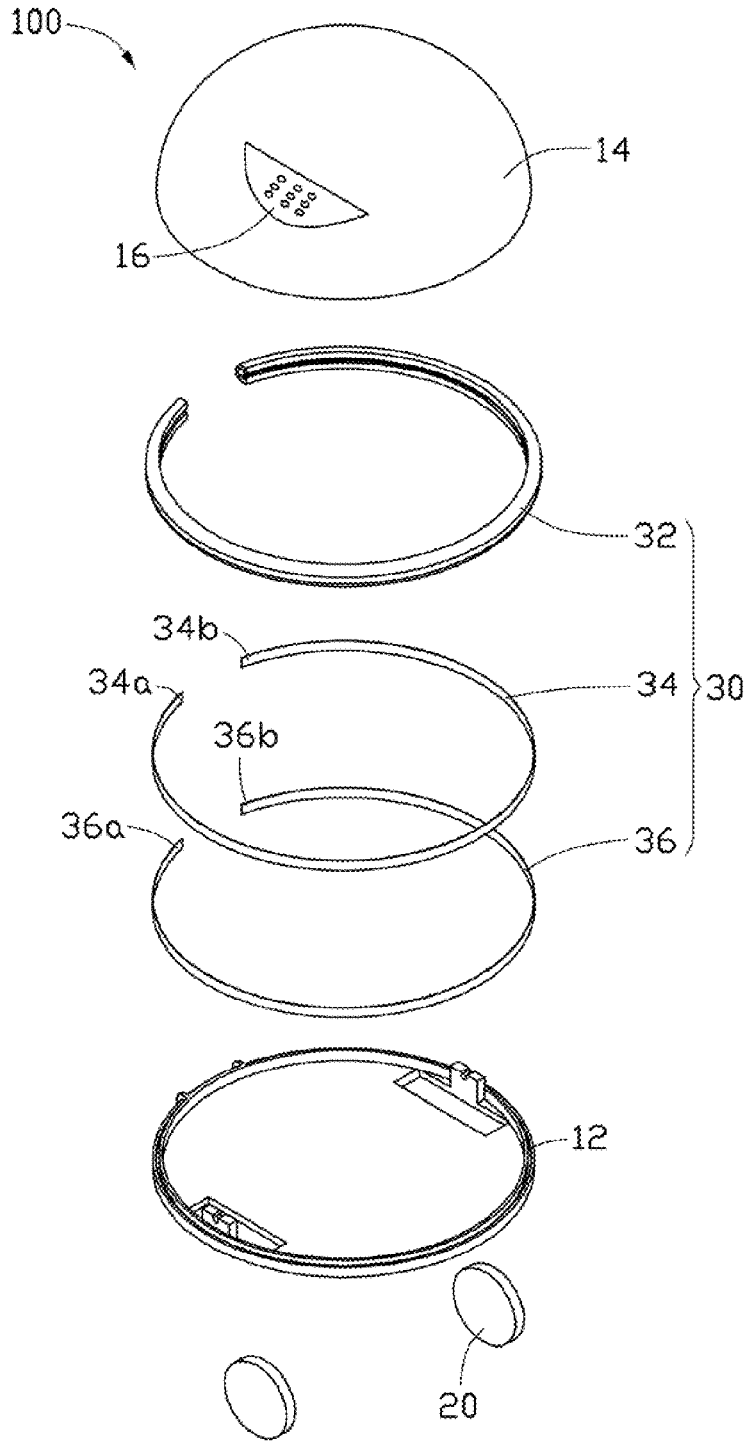
FIG. 1 is an isometric, exploded, schematic view of a touch sensitive robot, according to an exemplary embodiment of the present disclosure.
Figure 2:
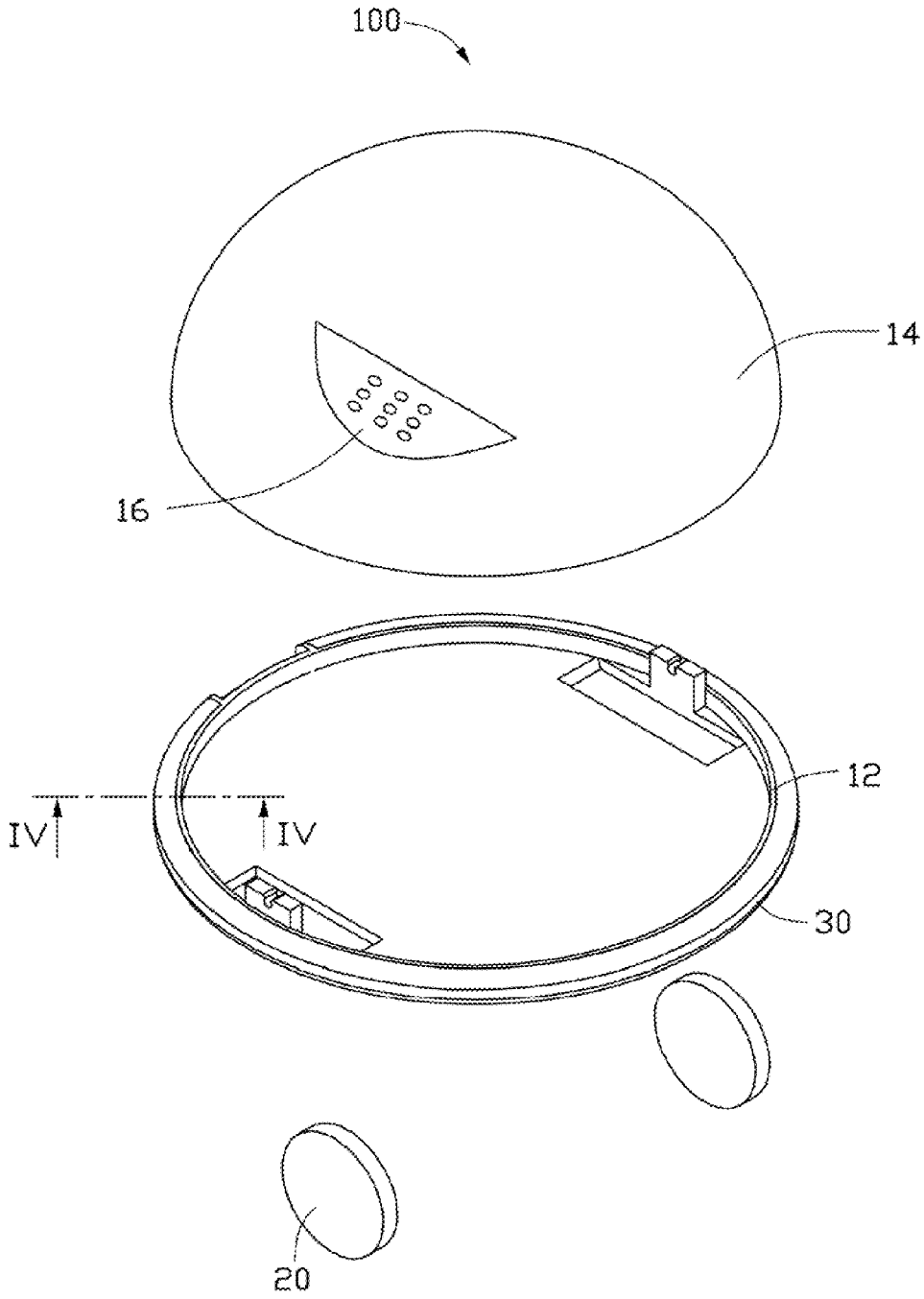
FIG. 2 is an isometric, partially assembled, schematic view of the touch sensitive robot of FIG. 1.
Figure 3:
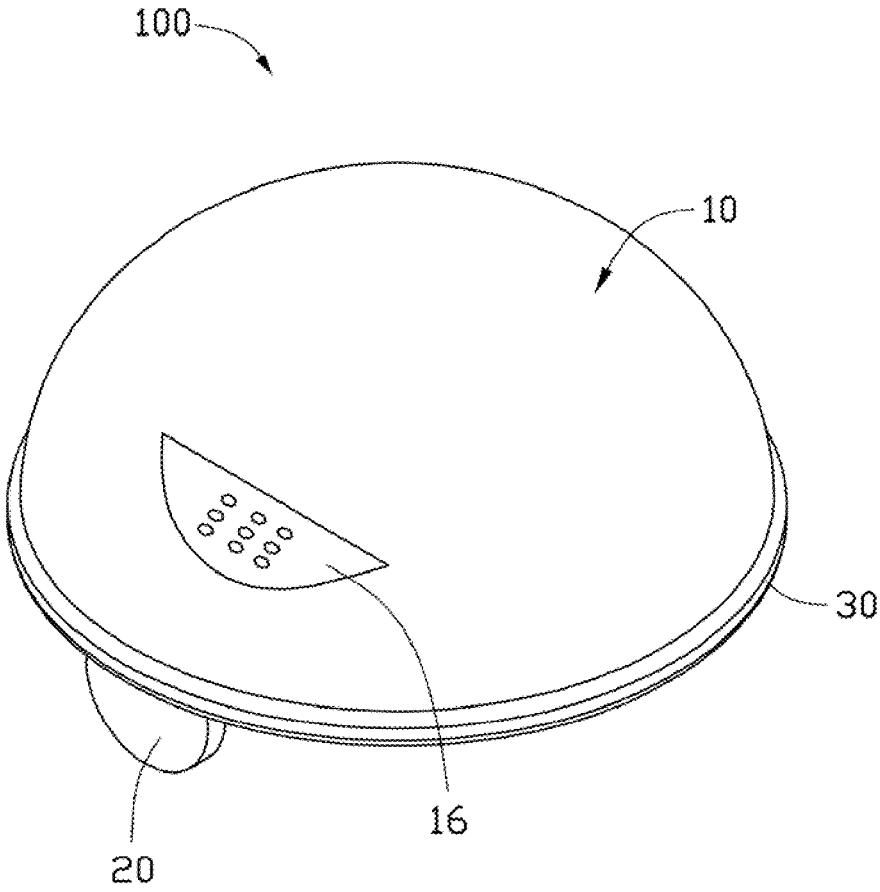
FIG. 3 is an isometric, assembled, schematic view of the touch sensitive robot of FIG. 1.

Referring to FIGS. 1-3, a touch sensitive robot 100, according to an exemplary embodiment, is disclosed. In this embodiment, the touch sensitive robot 100 is a robotic vacuum cleaner. However, in other alternative embodiments, the touch sensitive robot 100 can be other types of touch sensitive robots, e.g., human robots or animal robots. The touch sensitive robot 100 includes a body 10 and a touch sensor 30.

The body 10 includes a circular bottom board 12, a dome-shaped shell 14, an interaction section 16, and a pair of wheels 20. The circular bottom board 12 seals the dome-shaped shell 14. As such, the circular bottom board 12 and the dome-shaped shell 14 cooperatively define a closed space for accommodating various components of the touch sensitive robot 100. The interaction section 16 allows the touch sensitive robot 100 to mimic interaction. In this embodiment, the interaction section 16 is a control panel of the touch sensitive robot 100 and is mounted in the outer surface of the dome-shaped shell 14. However, in other alternative embodiments, the interaction section 16 can be in other form, corresponding to the type of touch sensitive robot. For example, the interaction section 16 can be a robotic head if the touch sensitive robot 100 is a representation of a human robot or an animal robot. The pair of wheels 20 is movably connected to the circular bottom board 12 to facilitate motion of the body 10. In particular, the pair of wheels 20 can rotate to propel the circular bottom board 12, the dome-shaped shell 14, and the interaction section 16 to move along/around. Also, the pair of wheels 20 can rotate independent of each other to drive the circular board 12, the dome-shaped shell 14, and the interaction section 16 to spin around.

Figure 4:
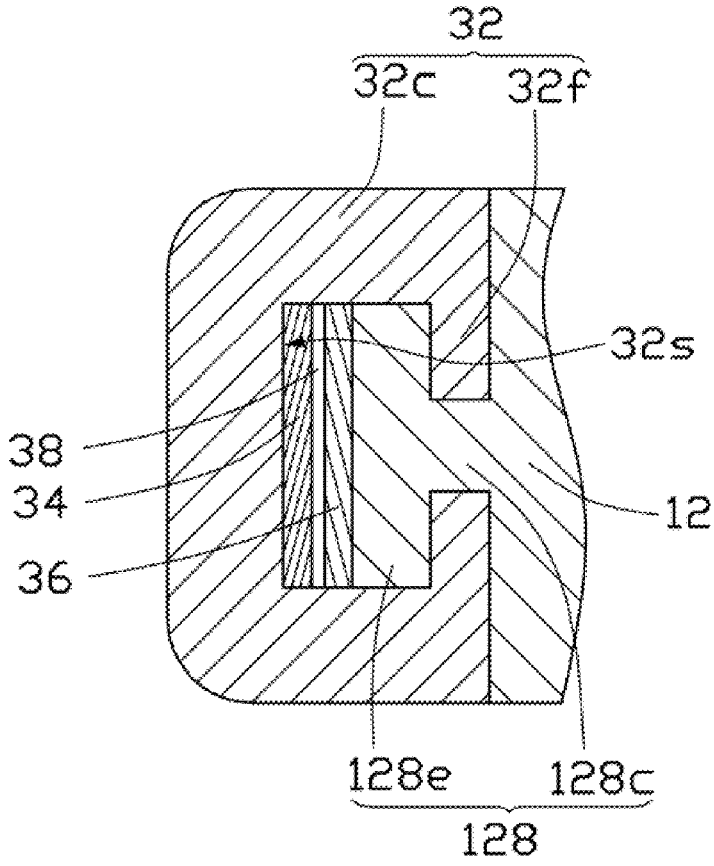
FIG. 4 is a partially cross-sectioned view taken along a line IV-IV of FIG. 2.

Also referring to FIG. 4, in this embodiment, the circular bottom board 12 includes an attachment portion 128. The attachment portion 128 extends outwards from and encircles the circumferential surface of the circular bottom board 12. As shown in FIG.3, in the cross-section taken along a left portion of the diameter of the circular bottom board 12, the attachment portion 128 includes a connecting plate 128*c* and an engaging plate 128*e*. The connecting plate 128*c* extends outwards away from the circumferential surface of the circular bottom board 12. The engaging plate 128*e* is connected to the connecting plate 128*c*, parallel to the circumferential surface of the circular bottom board 12. That is, the attachment portion 128 is a T-shaped plate connected to the circumferential surface of the circular bottom board 12.

The touch sensor 30 includes an isolating cover 32, a first conductive belt 34, and a second conductive belt 36.

As shown in FIG. 1, the isolating cover 32 is an opened ring in shape. As shown in FIG. 4, in the cross-section, the isolating cover 32 includes a cap-shaped covering section 32*c* and two engaging flanges 32*f*. The cap-shaped covering section 32*c* includes an inner bottom surface 32*s*. Each engaging flange 32*f* extends inwards from one of two ends of the cap-shaped covering section 32*c*. The isolating cover 32 is made of an isolating material such as rubber. In this embodiment, the isolating cover 32 is made of silica gel, which has an excellent elasticity and deforms instantly when touched.

The first conductive belt 34 includes a first end 34*a* and a second end 34*b*. The first conductive belt 34 is almost as long as the isolating cover 32. In this embodiment, the first conductive belt 34 is made of a conductive material of a high elasticity, e.g., conductive rubber. As such, the first conductive belt 34 also deforms instantly when touched.

The second conductive belt 36 includes a third end 36*a* and a fourth end 36*b*. The second conductive belt 36 is also as long as the isolating cover 32. The electric resistivity of the second conductive belt 36 is different from that of the first conductive belt 34. In this embodiment, the second conductive belt 36 is made of copper. Accordingly, the electric resistivity of the second conductive belt 36 is lower than that of the first conductive belt 34.

Referring to FIGS. 1 and 4, in assembly, the second conductive belt 36 is wrapped around the outer surface of the engaging plate 128*e*, but leaves a gap between the third end 36*a* and the fourth end 36*b*. The first conductive belt 34 is wrapped around the inner bottom surface 32*s* of the isolating cover 32. Then, the attachment portion 128 is covered by the isolating cover 32. In particular, the isolating cover 32 is attached to the attachment portion 128 via an engagement between the engaging flanges 32*f* and the engaging plate 128*e*. The distance between the inner bottom surface 32*s* and the engaging flanges 32*f* is longer/thicker than the total thickness of the engaging plate 128*e*, the first conductive belt 34, and the second conductive belt 36. As such, upon assembly, the first conductive belt 34 attached to the inner bottom surface 32*s* faces the second conductive belt 36 adhered to the engaging plate 128*e* at a distance, forming a gap 38 therebetween.

Figure 5:
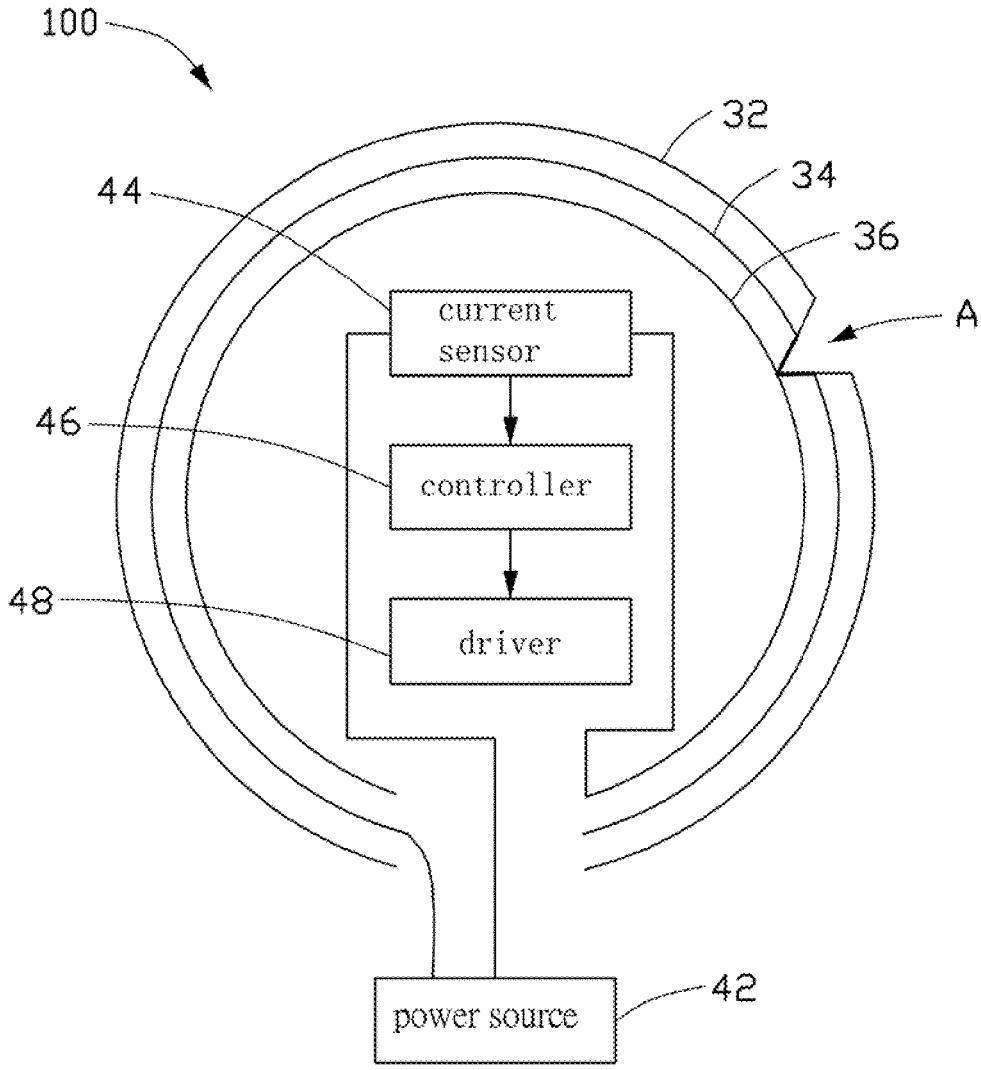
FIG. 5 is a schematic view of the touch sensitive robot of FIG. 1.

Further referring to FIG. 5, the touch sensor 30 further includes a power source 42 and a current sensor 44. The touch sensitive robot 100 further includes a controller 46 and a driver 48.

In assembly, the power source 42 and the current sensor 44 are connected in series between the first conductive belt 34 and the second conductive belt 36. The power source 42 is configured for supplying electrical power to the first conductive belt 34 and the second conductive belt 36. The current sensor 44 is configured for measuring the flow of the electrical current through the first conductive belt 34 and the second conductive belt 36 when the first conductive belt 34 is touched and electrically contacts the second conductive belt 36. In this embodiment, the power source 42 and the current sensor 44 are connected between the first end 34*a* and the fourth end

36*b*. However, it is not limited to this embodiment, the power source 42 and the current sensor 44 also can be connected to any point of the first conductive belt 34 and the second conductive belt 36. The controller 46 is connected to the current sensor 44 and is configured for controlling the driver 48 based upon the measurement of the current sensor 44. The driver 48 is connected to the controller 46 and is configured for driving the pair of wheels 20 to rotate.

In operation, when a touch is performed on a point A of the isolating cover 32, both the isolating cover 32 and the first conductive belt 34 deform, e.g., bent towards the second conductive belt 36. The first conductive belt 34 and the second conductive belt 36 contact each other at the point A. The power source 42, the current sensor 44, a portion of the first conductive belt 34 from the first end 34*a* to the touch point (hereinafter "the effective first conductive belt"), and a portion of the second conductive belt 36 from the fourth end 36*b* to the touch point (hereinafter "the effective second conductive belt") form a closed circuit. The flow of the electrical current of the closed circuit depends on the total resistance of the effective first conductive belt 34 and the effective second conductive belt 36. The flow of the electrical current of the closed circuit is measured by the current sensor 44. The total resistance of the effective first conductive belt 34 and the effective second conductive belt 36 depends on a location/position of the point A relative to the first conductive belt 34. In other words, the current sensor 44 can detect the location of the point A relative to the first conductive belt 34. Thereby, the controller 46 can control the driver 48 to drive the pair of the wheels 20 based upon the measurement of the current sensor 44. Accordingly, the pair of wheels 20 rotate independently of each other to spin the body 10 such that the interaction section 16 substantially changes position with the point A.

In the touch sensitive robot 100, only one touch sensor 30 is employed. In addition, the touch sensor 30 is made of inexpensive material and can be manufactured by simple processes. Therefore, the cost of the touch sensor 30 is low. As such, the cost of the touch sensitive robot 100 can be reduced.

It should be mentioned that the body 10 is not limited to this embodiment, but can be shaped and structured depending on the type of touch sensitive robot.

It should be noted that the touch sensor 30 is not limited to this embodiment. For example, the isolating cover 32 can be in other shapes, depending on practice requirements. The inner structure of the touch sensor 30 is not limited to this embodiment too. Any structure having a pair of spaced conductive belts can be used. Beneficially, the outer conductive belt has an excellent elasticity to deform in case of touch. The conductive belts better have different electric resistivities. In addition, the isolating cover 32, the first conductive belt 34, and the second conductive belt 36 can be elongated to wrap around the entire outer surface of the body 10.

The combination between the touch sensor 30 and the body 10 is not limited to this embodiment too. In other alternative embodiments, the touch sensor 30 can be attached to the body 10 using other techniques, e.g., adhesive.

While various exemplary and preferred embodiments have been described, it is to be understood that the invention is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A touch sensitive robot comprising:

a body comprising an interaction section;

a touch sensor comprising:

a first conductive belt being wrapped on the body;

a second conductive belt being wrapped around but spaced away from the first conductive belt;

a power source and a current sensor connected in series between the first conductive belt and the second conductive belt, the touch sensor being configured for sensing a touch on the second conductive belt;

a driver; and a controller configured for controlling the driver to turn the body based upon the measurement of the current sensor such that the interaction section substantially changes position to the point of the touch on the second conductive belt, wherein the body further comprises a circular bottom board, a dome-shaped shell, and a pair of wheels, the circular bottom board sealing the dome-shaped shell, the interaction section being mounted in the outer surface of the dome-shaped shell, the pair of wheels being movably fixed to the circular bottom board and capable of turning the body, wherein the body further comprises an attachment portion extending outwards from and encircling the circumferential surface of the circular bottom board, the touch sensor further comprises an isolating cover, the isolating cover covering the attachment portion and defining a space between the isolating cover and the attachment portion, the first conductive belt and the second conductive belt being received in the space, the first conductive belt being attached to the isolating cover, the second conductive belt being attached to the attachment portion, the first conductive belt and the second conductive belt facing but being spaced away from each other, and wherein in a cross-section taken along the diameter of the circular bottom board, the attachment portion comprises a connecting plate extending away from the circumference surface of the circular bottom board and an engaging plate extending away from the connecting plate, parallel to the circumference surface of the circular bottom board, the isolating cover comprises a cap-shaped covering section and two engaging flanges inwards from two ends of the cap-shaped covering section, the engaging flanges engaging with the engaging plate.

* * * * *